US011109685B1

(12) United States Patent
Yang

(10) Patent No.: US 11,109,685 B1
(45) Date of Patent: Sep. 7, 2021

(54) FLEXIBLE FURNITURE BACK

(71) Applicant: James Yang, Ontario, CA (US)

(72) Inventor: James Yang, Ontario, CA (US)

( * ) Notice: Subject to any disclaimer, the term of this patent is extended or adjusted under 35 U.S.C. 154(b) by 0 days.

(21) Appl. No.: 17/174,932

(22) Filed: Feb. 12, 2021

Related U.S. Application Data

(60) Provisional application No. 62/976,512, filed on Feb. 14, 2020.

(51) Int. Cl.

| | |
|---|---|
| ***A47C 4/02*** | (2006.01) |
| ***A47C 7/34*** | (2006.01) |
| ***A47C 13/00*** | (2006.01) |
| ***A47C 17/04*** | (2006.01) |
| ***A47C 17/86*** | (2006.01) |
| ***A47C 7/18*** | (2006.01) |
| ***A47C 1/032*** | (2006.01) |

(52) U.S. Cl.
CPC ..... *A47C 17/04* (2013.01); *A47C 1/03261* (2013.01); *A47C 7/185* (2013.01); *A47C 7/34* (2013.01); *A47C 17/86* (2013.01)

(58) Field of Classification Search
CPC ..... A47C 1/03261; A47C 7/185; A47C 7/34; A47C 17/04; A47C 17/86
USPC .... 297/440.1, 440.14, 452.49, 452.5, 452.51
See application file for complete search history.

(56) References Cited

U.S. PATENT DOCUMENTS 2,280,231 A 4/1942 Gulley
2,697,233 A 12/1954 Christenson
2,927,328 A * 3/1960 Rater ..... A47C 17/16 5/52
3,084,980 A * 4/1963 Lawson ..... A47C 7/20 297/452.5 X
3,817,574 A 6/1974 McNab
3,944,281 A * 3/1976 Piretti ..... A47B 87/00 297/440.14
3,981,031 A 9/1976 Schacht
4,046,421 A * 9/1977 Spound ..... A47C 13/005 297/452.51 X
4,077,666 A * 3/1978 Heumann ..... A47C 13/005 297/440.14 X
5,000,512 A * 3/1991 Laird ..... A47C 4/02 297/440.1 X
5,232,266 A * 8/1993 Mork ..... A47C 7/14 297/452.5
5,353,450 A 10/1994 Katan
5,356,201 A 10/1994 Olson
5,580,130 A 12/1996 Williams et al.
5,934,751 A 8/1999 Johnson et al.
6,352,306 B1 3/2002 Dreiling
6,367,880 B1 * 4/2002 Niederman ..... A47C 4/02 297/440.14
6,827,407 B2 * 12/2004 Niederman ..... A47C 4/02 297/440.14 X
7,020,911 B2 * 4/2006 Oldham ..... A47C 13/005 297/440.1 X (Continued)

*Primary Examiner* — Rodney B White
(74) *Attorney, Agent, or Firm* — Cramer Patent & Design, PLLC.; Aaron R. Cramer

(57) ABSTRACT

A flexible furniture back with "U" clamp is a steel sofa or chair back having a U-shaped clamp secured to a sofa or chair base providing a back capable of horizontal movement. The furniture back has a plurality of steel cross-member supports. Additionally, the furniture back has padding about the front face and rear face of the back thereby providing cushioning.

18 Claims, 6 Drawing Sheets

(56) References Cited

U.S. PATENT DOCUMENTS 7,128,960 B2 10/2006 Walz et al.
7,213,885 B2 * 5/2007 White, III ..... A47C 13/005 297/440.1
7,237,845 B2 * 7/2007 Mulmed ..... A47C 7/24 297/440.1 X
7,347,493 B2 * 3/2008 Mulmed ..... A47B 87/007 297/452.52 X
7,547,073 B2 * 6/2009 White, III ..... A47C 13/005 297/440.1
7,758,119 B1 7/2010 Baterdouk
8,459,738 B2 6/2013 Downey
8,528,972 B2 * 9/2013 Johnsson ..... A47C 4/02 297/440.14 X
8,561,666 B2 10/2013 MacAllen et al.
8,627,523 B2 1/2014 Kaiser
8,783,778 B2 * 7/2014 Nelson ..... A47C 3/029 297/440.1
9,277,826 B2 * 3/2016 Nelson ..... A47C 17/045
9,309,668 B2 4/2016 MacAllen et al.
9,394,686 B2 7/2016 MacAllen et al.
9,797,134 B2 10/2017 MacAllen et al.
10,098,470 B2 10/2018 Huang et al.
10,123,623 B2 * 11/2018 Nelson ..... A47C 7/20
10,433,648 B1 10/2019 Kuhl et al.
10,506,883 B2 12/2019 Hirschhaut
10,743,676 B1 * 8/2020 Galjour ..... A47C 31/00
10,813,482 B2 10/2020 Oliver
10,835,043 B2 11/2020 Ferguson
11,007,400 B1 * 5/2021 Stoddard ..... A63B 21/4029
2002/0093235 A1 * 7/2002 Niederman ..... A47C 4/02 297/440.1
2007/0085406 A1 * 4/2007 White, III ..... A47C 4/028 297/440.1
2008/0012416 A1 * 1/2008 Richey ..... A47C 17/14 297/440.16
2009/0045666 A1 * 2/2009 Westendorf ..... A47C 4/03 297/440.1
2017/0000259 A1 1/2017 Tsuchiyama et al.
2019/0142165 A1 * 5/2019 Nelson ..... A47C 4/028 297/440.14

* cited by examiner

FLEXIBLE FURNITURE BACK

RELATED APPLICATIONS

The present invention is a continuation of, was first described in, and claims the benefit of U.S. Provisional Application No. 62/976,512 filed Feb. 14, 2020, the entire disclosures of which are incorporated herein by reference.

FIELD OF THE INVENTION

The present invention relates to a back of a piece of furniture, such as a chair or sofa, that is flexible.

BACKGROUND OF THE INVENTION

There is almost an unlimited selection of padded furniture such as sofas and chairs available for purchase. Such selections run the gamut of size, color, and style to fit in any location and in any décor. However, one thing all such furniture has in common is its construction. It is almost always made with a wood frame, steel spring, padding and an outer fabric.

While such construction feels good when initially sitting on it, it rapidly becomes uncomfortable just a few months later. Not only do springs lose their spring, but they can break and become loose. Padding quickly becomes irreversibly compressed leading to sagging cushions. Finally, the back structure on much of this furniture is a weak point and can break not only when sit upon but can also break when children play on them or jump off of them.

Accordingly, there exists a need for a means by which a sofas, chairs, and other similar padded furniture can be improved upon to address the problems as described above. The development of the flexible furniture back fulfills this need.

SUMMARY OF THE INVENTION

The principles of the present invention provide for a padded furniture having a flexible back support which in turn has a plurality of intermediates supports, a seating surface with a plurality of enhanced materials, a sofa base having a main horizontal seating surface, a plurality of sofa sections which are joined together by a plurality of base connector brackets which connect across the wood base in each of the sofa sections, a pair of layers of a first foam core, and a layer of spring coils which is disposed on top a second layer of durable fabric which provides protection for a second foam core. The sofa base includes a sofa frame, a spring layer, and a top cushion, and a wood base.

The flexible back support may be a flexible chair back support. The flexible back support may be a metal back support for comfort, durability, and easier manufacturing. The flexible back support may have a "U"-shaped mounting bracket which may be placed over a lower portion of the wood base as defined by a placement travel path "p". The "U"-shaped mounting bracket may be secured by at least a pair of mounting screws placed through respective a pair of mounting holes located in the mounting bracket. The back support structure may be attached to the mounting bracket and form the flexible back. The sofa base may be selected from the group consisting of a corner piece in a sectional sofa, a conventional sofa, a padded chair.

The wood base may be located at the lowermost portion of the sofa base and may be provided with an opening which occupies an upper surface. The padded furniture may also have a plurality of carbon fiber rods covers the opening and is fastened in place by one or more tie-down clips. The carbon fiber rods are made of a pultrusion duroplastic resin. Each of the base connector brackets may be provided with a pair of protruding members connected by a connecting member. Each of the base connector brackets may be positioned by a force 'f' to produce a friction fit between the pair of protruding members and the wood base. The first foam core may each made of a two inch thick middle foam core with a two-point eighteen density. Above the uppermost first foam core may be a first layer of durable fabric to provide physical protection for the first foam core. The uppermost layer may be a fiber fill layer made of white non-recycled material. The spring coils may be nineteen gauge. The second foam core may be made of one-and-a-half inches of memory foam of four density. The flexible back may provide an easy to attach back surface that is strong and will stand up to a plurality of high forces from one or more overweight adults and one or more rambunctious children that climb and/or jump on the back support structure.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
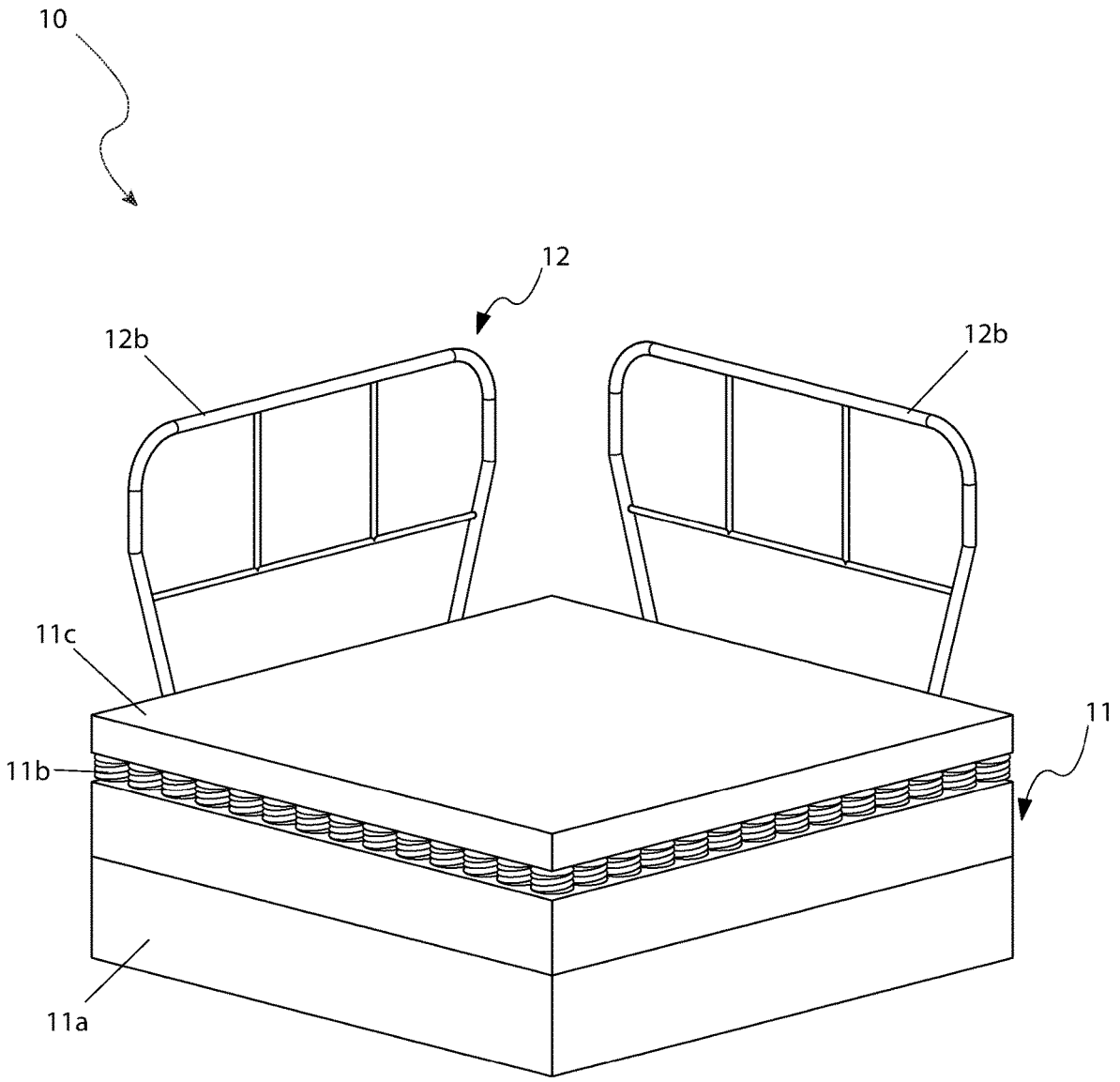
FIG. 1 is a front perspective view of padded furniture with flexible back support, according to the preferred embodiment of the present invention.

10 padded furniture
11 sofa base
11*a* sofa frame
11*b* spring layer
11*c* top cushion
12 flexible back support
12*a* mounting bracket
12*b* back support structure
12*c* mounting hole
12*d* mounting screw
14 base connector bracket
15 wood base
25 placement travel path "p"

30 sofa section
35 intermediate support
40 protruding member
45 connecting member
50 force 'f'
55 opening
60 carbon fiber rod
65 tie-down clip
70 first foam core
75 first layer of durable fabric
80 spring coil
85 second layer of durable fabric
90 second foam core
95 fiber fill layer

DESCRIPTION OF THE PREFERRED EMBODIMENTS

The best mode for carrying out the invention is presented in terms of its preferred embodiment, herein depicted within FIGS. 1 through 7. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a front perspective view of padded furniture 10 with a flexible back support 12, according to the preferred embodiment of the present invention is disclosed. The padded furniture (herein also described as the "furniture") 10, provides for a seating surface with multiple enhanced materials and a metal back support 12 for comfort and durability as well as easier manufacturing efforts. A sofa base 11 is provided as the main horizontal seating surface of the furniture 10. The sofa base 11 as depicted in FIG. 1, is shown as a corner piece in a sectional sofa. However, the teachings of the furniture 10 can be used with any type of padded seating surface such as a conventional sofa, a padded chair, or the like. As such, the teachings of the furniture 10 shall not be limited to any particular type of padded seating surface. The various layers comprising the sofa base 11 will be described in greater detail herein below. At least one (1) flexible back 12 including a back support structure 12*b* is provided along adjacent sides of the sofa base 11.

Figure 2:
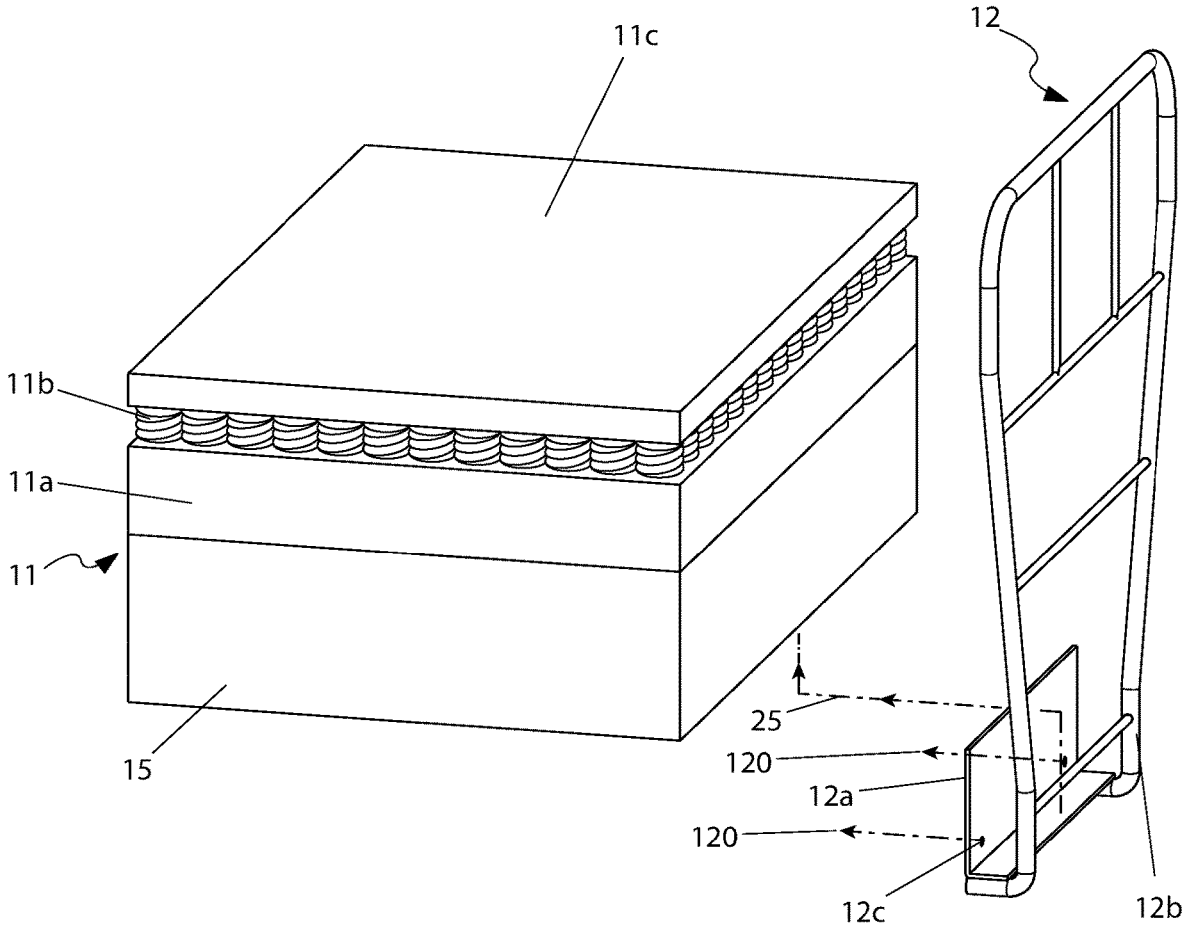
FIG. 2 is an exploded perspective view of padded furniture with back support, according to the preferred embodiment of the present invention.

Referring next to FIG. 2, an exploded perspective view of the furniture 10, according to the preferred embodiment of the present invention is depicted. The sofa base 11 includes a sofa frame 11*a*, a spring layer 11*b*, and a top cushion 11*c*. The sofa base 11 further is provided with a wood base 15. The flexible back 12 is provided with a "U"-shaped mounting bracket 12*a* which is placed over the lower portion of the wood base 15 as defined by a placement travel path "p" 25. Once in place, the bracket 12*a* is secured by at least two (2) mounting screws 12*d* placed through respective mounting holes 12*c* located in the mounting bracket 12*a*. The back support structure 12*b* are then attached to the mounting bracket 12*a* and form the flexible back 12 as aforementioned described.

Figure 3:
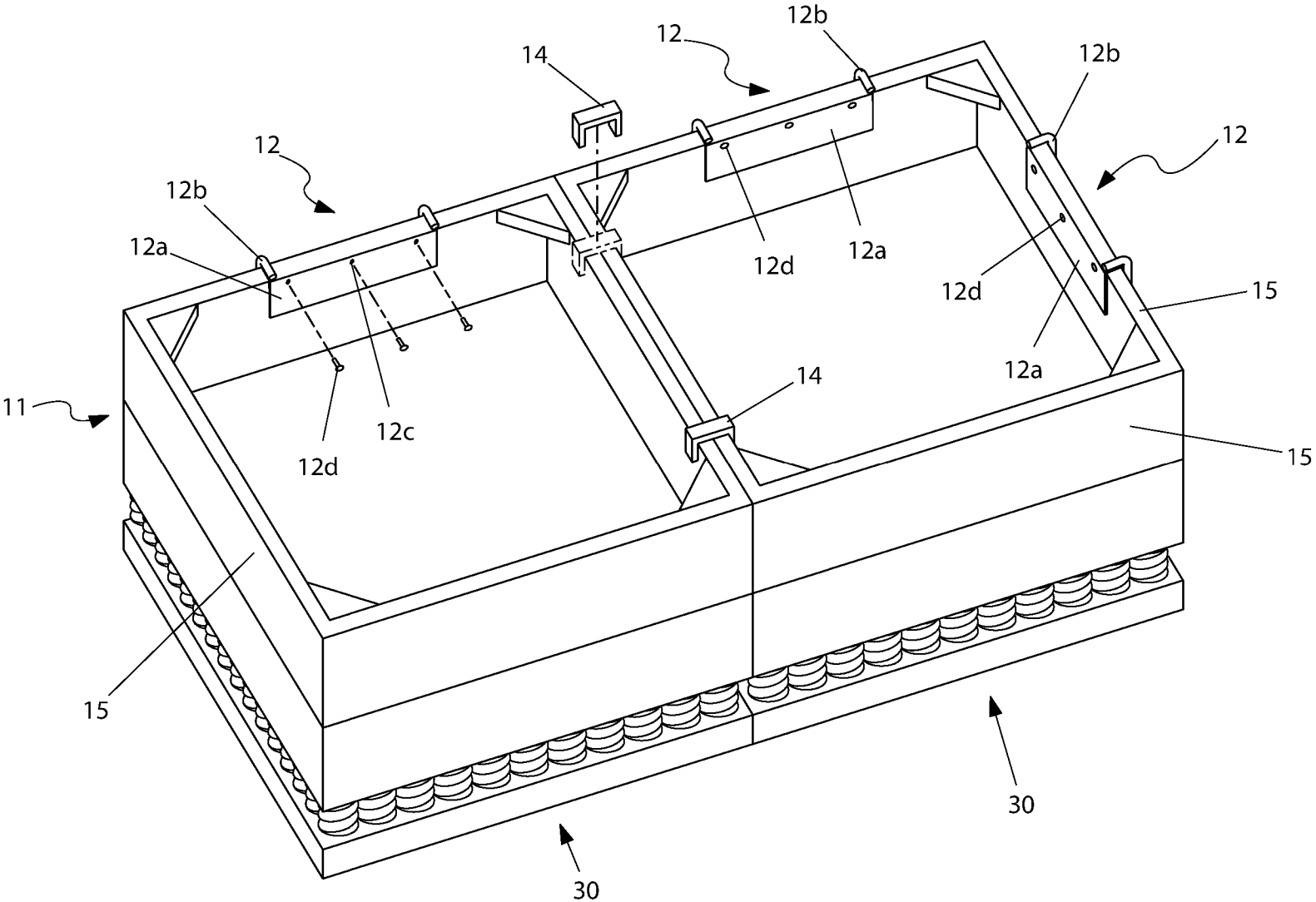
FIG. 3 is an inverted bottom perspective view of padded furniture with flexible back support according to an alternate embodiment of the present invention.

Referring now to FIG. 3, an inverted bottom perspective view of the furniture 10 according to an alternate embodiment of the present invention is shown. The alternate embodiment is specific to a sectionalized sofa. The two (2) sofa sections 30 are joined together by at least two (2) base connector brackets 14 which connect across the wood base 15 as provided in each sofa sections 30. The base connector brackets 14 will be described in greater detail herein below. The attachment of the multiple back support structure 12*b* to the mounting bracket 12*a* and the corresponding connection of the mounting bracket 12*a* to the wood base 15 via the mounting screws 12*d* through the mounting holes 12*c* is more clearly shown.

Figure 4:
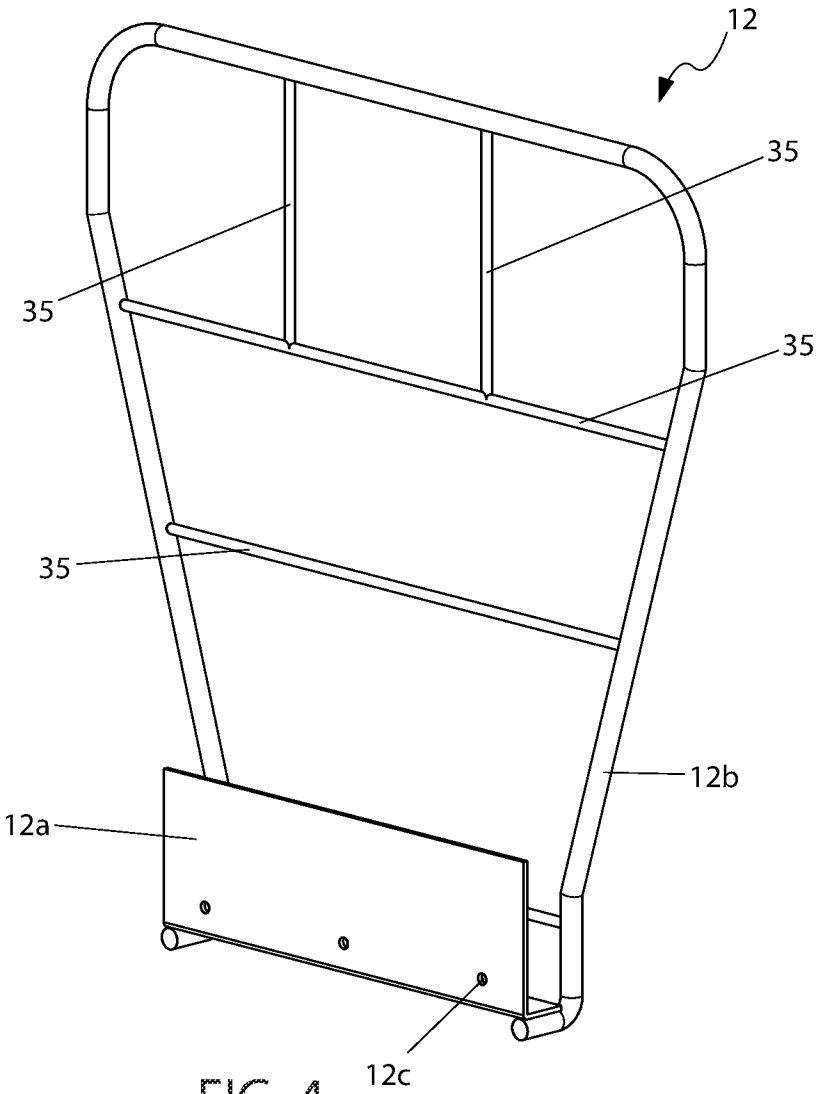
FIG. 4 is a perspective view of the flexible back as used with the padded furniture, according to the preferred embodiment of the present invention.

Referring next to FIG. 4, a perspective view of the flexible back 12 as used with the furniture 10, according to the preferred embodiment of the present invention is disclosed. The flexible back 12 in addition to the back support structure 12*b* are provided with a plurality of intermediates supports 35. The flexible back 12 may or may not be covered with additional padding or surface textiles. The multiple mounting holes 12*c* are shown in the mounting bracket 12*a* are for the purposes of accepting the mounting screws 12*d* as shown in FIG. 1 and FIG. 2.

Figure 5:
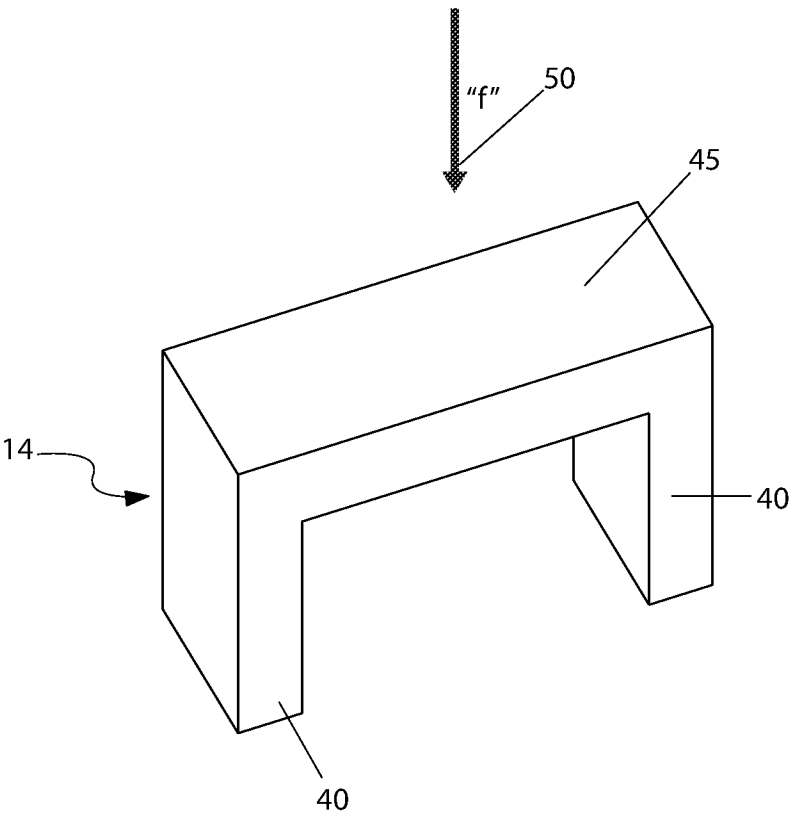
FIG. 5 is a detailed perspective view of the base connector brackets, as used with the padded furniture with flexible back support, according to the preferred embodiment of the present invention.

Referring now to FIG. 5, a detailed perspective view of the base connector brackets 14, as used with the furniture 10, according to the preferred embodiment of the present invention is depicted. Each base connector bracket 14 is provided with two (2) protruding members 40 connected by one (1) connecting member 45. Each base connector bracket 14 is positioned (as shown in FIG. 3) by the application of a force 'f' 50 to produce a friction fit between the protruding members 40 and the wood base 15 (as shown in FIG. 3).

Figure 6:
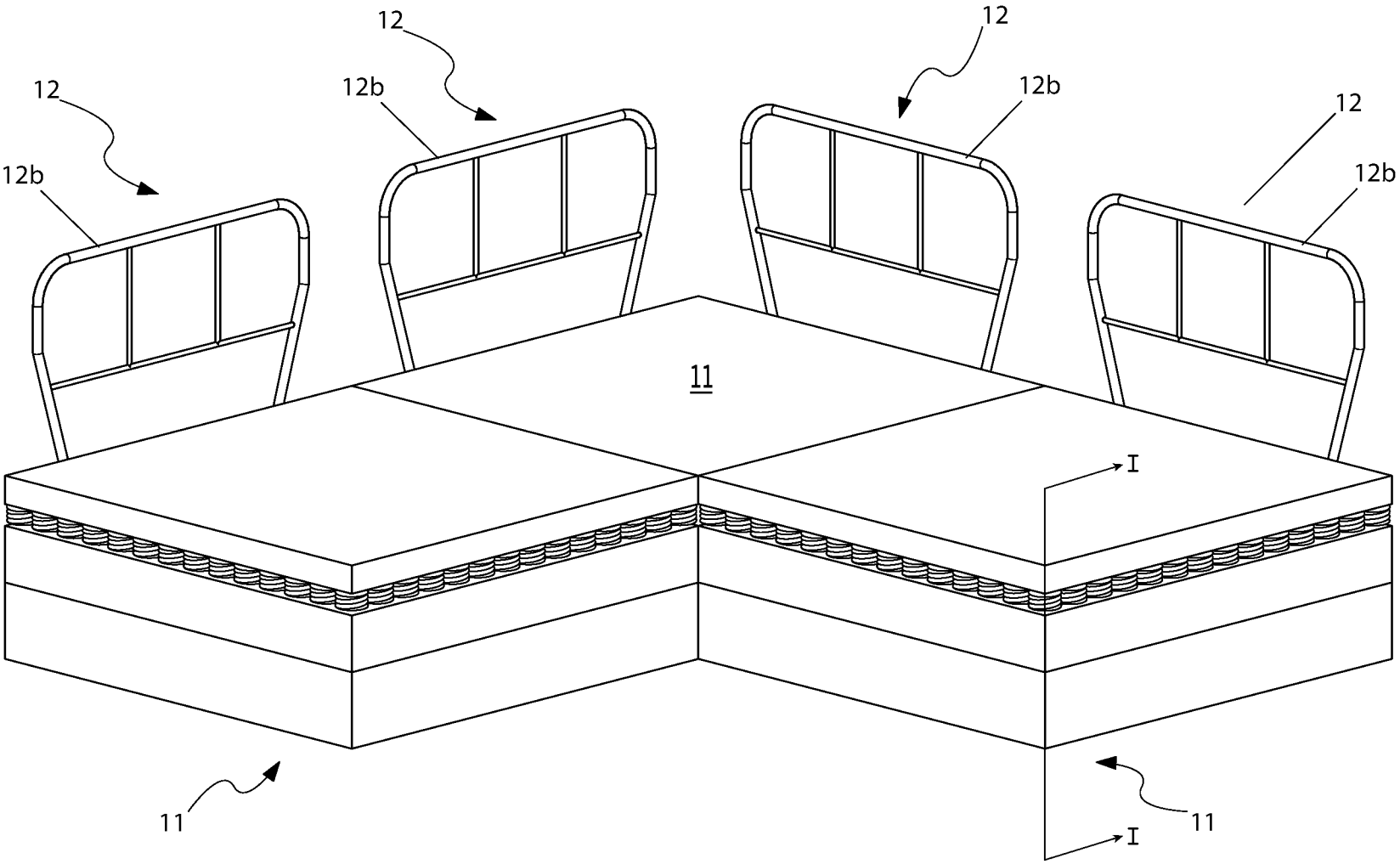
FIG. 6 is a front perspective view of the padded furniture with flexible back support, according to an alternate embodiment of the present invention.

Referring next to FIG. 6, a front perspective view of the furniture 10, according to an alternate embodiment of the present invention is shown. This embodiment is once again for a sectionalized sofa, although the teachings of the furniture 10 apply to any type of padded chairs or sofas. The back surfaces of each sofa section 30 are provided with a flexible back 12 having multiple sections of back support structure 12*b*. The flexible back 12 provides an easy to attach back surface that is strong and will stand up to the heaviest of abuse including high forces from overweight adults and any rambunctious children that should climb and/or jump from the back of the furniture 10. The construction of the flexible back 12 makes it nearly impossible to break by human hands alone.

Figure 7:
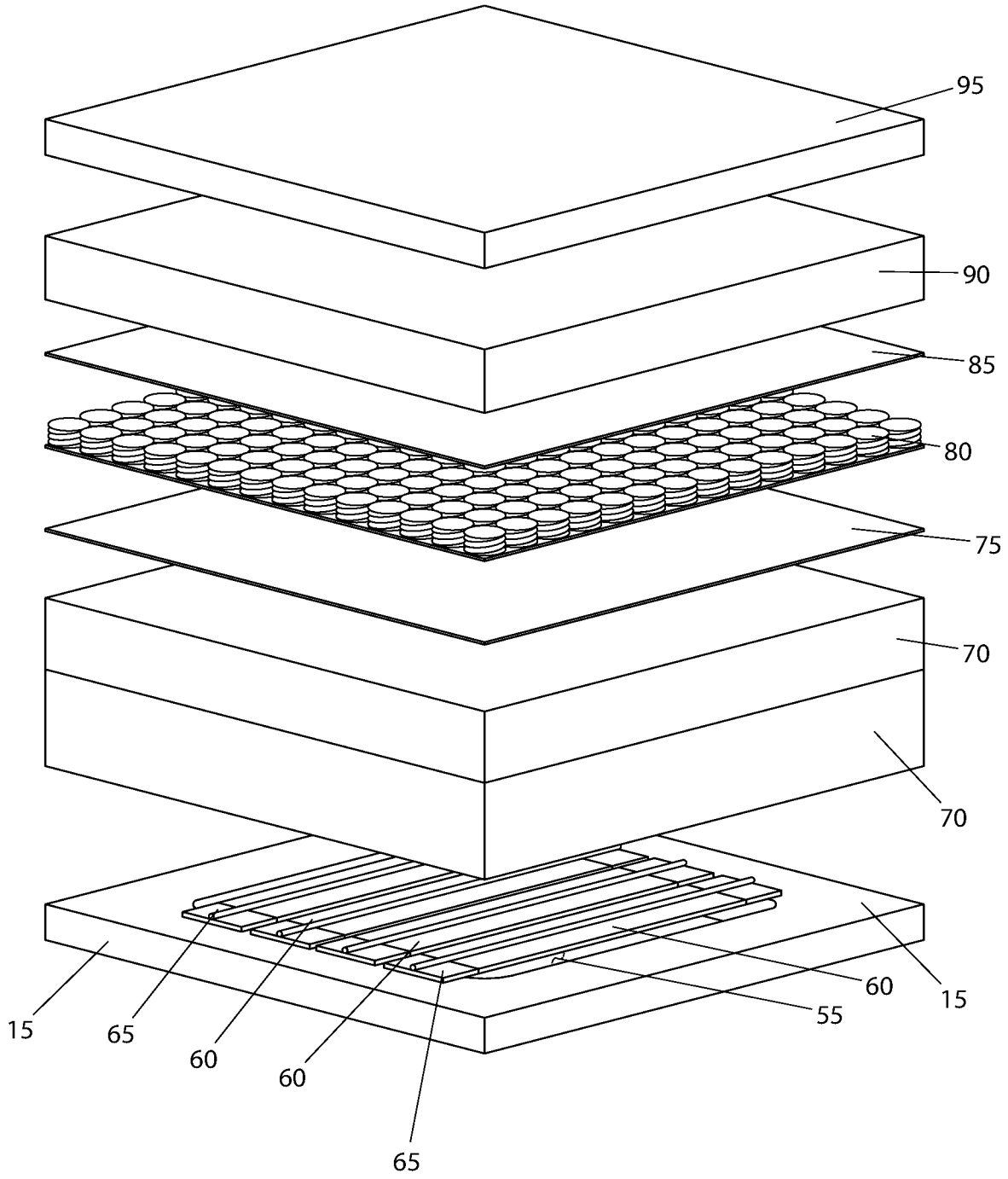
FIG. 7 is an exploded sectional view of the sofa base, as seen along a line I-I, as shown in FIG. 6, according to the second alternate embodiment of the present invention.

Referring finally to FIG. 7, an exploded sectional view of the sofa base 11 as seen along a line I-I, as shown in FIG. 6, according to the second alternate embodiment of the present invention is disclosed. The wood base 15 is located at the lowermost portion of the sofa base 11 and is provided with an opening 55 which occupies the predominant portion of the upper surface. A plurality of carbon fiber rods 60, each manufactured of a pultrusion duroplastic resin, covers the opening 55 and is fastened in place using tie-down clips 65. Above that is provided two (2) layers of a first foam core 70, each made of a two inch (2 in.) thick middle foam core with a two-point eighteen (2.18) density—firm compression. Above the uppermost first foam core 70 is a first layer of durable fabric 75 to provide physical protection for the first foam core 70. Next is a layer of nineteen (19) gauge spring coils 80. On top of the spring coils 80 is located a second layer of durable fabric 85 which provides protection for a second foam core 90 made of one-and-a-half inches (1½ in.) of memory foam of four (4.0) density. Finally, the uppermost layer is a fiber fill layer 95 made of white non-recycled material. It is noted that an outer durable upholstery textile may be placed over all layers shown in FIG. 7 to provide an overall aesthetically pleasing appearance.

2. Operation of the Preferred Embodiment

The preferred embodiment of the present invention can be utilized by the common user in a simple and effortless manner with little or no training. It is envisioned that the furniture 10 would be constructed in general accordance with FIG. 1 through FIG. 7. The user would procure the furniture 10 from conventional procurement channels such as furniture stores, discount stores, department stores, warehouse stores, mail order and internet supply houses and the like. Special attention would be paid to the overall size, style, appearance, and color of the furniture 10 such that it physically fits in the desired usage space and complements the existing décor.

After procurement and prior to utilization, the furniture 10 would be prepared in the following manner: the various sofa sections 30, if present, would be inverted as shown in FIG. 3; the mounting bracket 12*a* would be placed over the wood base 15; the mounting screws 12*d* would be inserted into the mounting holes 12*c* and attached to the wood base 15; the various sofa bases 11 in the case of the sofa sections 30 would be connected together via use of the base connector brackets 14 which are installed by applying force 'f' 50; and, the furniture 10 would then be inverted again to place it ready into a usage position.

During utilization of the furniture 10, the following procedure would be initiated: the user would sit upon the sofa base 11 and, while resting against the flexible back 12 being rewarded with a comfortable and long-lasting seating surface and a flexible back 12 which will not break even under the toughest of usage conditions.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A padded furniture, comprising:

a flexible back support having a plurality of intermediate supports;

a seating surface with a plurality of enhanced materials;

a sofa base having a main horizontal seating surface, the sofa base includes a sofa frame, a spring layer, and a top cushion, and a wood base;

a plurality of sofa sections joined together by a plurality of base connector brackets which connect across the wood base in each of the sofa sections; a pair of layers of a first foam core; and a layer of spring coils disposed on top a second layer of durable fabric which provides protection for a second foam core.

2. The padded furniture, according to claim 1, wherein the flexible back support is a flexible chair back support.

3. The padded furniture, according to claim 1, wherein the flexible back support is a metal back support for comfort, durability, and easier manufacturing.

4. The padded furniture, according to claim 1, wherein the flexible back support has a "U"-shaped mounting bracket which is placed over a lower portion of the wood base as defined by a placement travel path "p".

5. The padded furniture, according to claim 4, wherein the "U"-shaped mounting bracket is secured by at least a pair of mounting screws placed through a respective pair of mounting holes located in the mounting bracket.

6. The padded furniture, according to claim 1, wherein the back support structure is attached to a mounting bracket and form the flexible back.

7. The padded furniture, according to claim 1, wherein the sofa base is selected from the group consisting of a corner piece in a sectional sofa, a conventional sofa, a padded chair.

8. The padded furniture, according to claim 1, wherein the wood base is located at a lowermost portion of the sofa base and is provided with an opening which occupies an upper surface.

9. The padded furniture, according to claim 1, further comprising a plurality of carbon fiber rods which covers the opening and is fastened in place by one or more tie-down clips.

10. The padded furniture, according to claim 9, wherein the carbon fiber rods are made of a pultrusion duroplastic resin.

11. The padded furniture, according to claim 1, wherein each of the base connector brackets are provided with a pair of protruding members connected by a connecting member.

12. The padded furniture, according to claim 1, wherein each of the base connector brackets are positioned by a force 'f' to produce a friction fit between a pair of protruding members and the wood base.

13. The padded furniture, according to claim 1, wherein the first foam core are each made of a two inch thick middle foam core with a two-point eighteen density.

14. The padded furniture, according to claim 1, wherein above an uppermost first foam core is a first layer of durable fabric to provide physical protection for the first foam core.

15. The padded furniture, according to claim 14, wherein an uppermost layer is a fiber fill layer made of white non-recycled material.

16. The padded furniture, according to claim 1, wherein the spring coils are nineteen gauge.

17. The padded furniture, according to claim 1, wherein the second foam core is made of one-and-a-half inches of memory foam of four density.

18. The padded furniture, according to claim 1, wherein the flexible back provides an easy to attach back surface that is strong and will stand up to a plurality of high forces from one or more overweight adults and one or more rambunctious children that climb and/or jump on the back support structure.

* * * * *